US005707171A

United States Patent [19]

Zaleski et al.

[11] Patent Number: 5,707,171

[45] Date of Patent: Jan. 13, 1998

[54] ELECTRICALLY CONDUCTIVE PAVING MIXTURE AND PAVEMENT SYSTEM

[76] Inventors: Peter L. Zaleski, 155 Glenwood, Willow Springs, Ill. 60480; David J. Derwin, 1792 Linden, Des Plaines, Ill. 60018; Walter H. Flood, Jr., 1945 E. 87th St., Chicago, Ill. 60617

[21] Appl. No.: 534,196

[22] Filed: Sep. 26, 1995

[51] Int. Cl.[6] ..... E01C 3/00

[52] U.S. Cl. ..... 404/28; 404/84.05

[58] Field of Search ..... 404/28, 79, 80, 404/84.05

[56] References Cited

U.S. PATENT DOCUMENTS

| | | | |
|---|---|---|---|
| 2,729,770 | 4/1956 | Robbins et al. . | |
| 3,377,462 | 4/1968 | Pferschy . | |
| 3,573,427 | 4/1971 | Minsk . | |
| 4,301,356 | 11/1981 | Tanei et al. . | |
| 4,319,854 | 3/1982 | Marzocchi | 404/28 |
| 4,571,860 | 2/1986 | Long | 404/31 |
| 4,697,063 | 9/1987 | Germundson . | |
| 5,352,275 | 10/1994 | Nath et al. | 95/117 |
| 5,447,564 | 9/1995 | Xie et al. . | |

OTHER PUBLICATIONS

L. David Minsk, U.S. Army Cold Regions Research and Engineering Laboratory Hanover, New Hampshire 03755 *Electrically Conductive Asphalt for Control of Snow and Ice Accumulation*, For presentation at the 47th Annual Meeting of the Highway Research Board, Session 35, Jan. 17, 1968, Washington, D.C. *"NOT FOR PUBLICATION"*.

*Primary Examiner*—Lincoln Donovan
*Attorney, Agent, or Firm*—Cook, McFarron & Manzo, Ltd.

[57] ABSTRACT

An electrically conductive paving mixture for use in a pavement system which prevents the accumulation of frozen precipitation on surfaces, for example, like that of an airport runway. The pavement system comprises a layer of electrically conductive paving mixture, a layer of insulative paving mixture, electrically resistive cables, an electrical power supply, sensors for measuring humidity and temperature, and a control and monitoring system. The electrically conductive paving mixture comprises a blend of naturally-occurring amorphous graphite and synthetic graphite/desulfurized petroleum coke. Preferably, the blend of naturally-occurring graphite to synthetic graphite/desulfurized produced coke is in the ratio of 2:1.

13 Claims, No Drawings

ELECTRICALLY CONDUCTIVE PAVING MIXTURE AND PAVEMENT SYSTEM

BACKGROUND OF THE INVENTION

This invention relates to an electrically conductive paving mixture used as part of a pavement system to prevent the accumulation of frozen precipitation by electrically-generated heat. In particular, this invention relates to an electrically conductive paving mixture made electrically conductive by the addition of a blend of graphite particles to a bituminous concrete.

Frozen precipitation, such as snow, ice and freezing rain, for example, has long been a source of concern for the air transport industry. The accumulation of frozen precipitation at an airport can have an almost immediate effect on the timing and safety of arriving and departing flights. Under adverse weather conditions, it is common for airport runways to be closed to traffic pending the removal of snow or ice so as to prevent a serious accident from occurring.

Runway and total airport closures directly affect the airline industry both in the form of customer dissatisfaction and in the loss of the value of flights both delayed and cancelled. Additionally, the airport operator assumes increased responsibilities during adverse weather conditions. The airport operator must ensure the safety of operations in the movement area, and must also attempt to keep the airport open in order to service its customers, the airlines.

Consequently, airport operators have an incentive to find a system of frozen precipitation removal that will minimize the cost and the time necessary to clear the runways. In doing so, the airport operator will often consider such factors as the geographic location of the airport, the type and quantity of the frozen precipitation, and the number of runways required by the airlines. Also of growing concern to airport operators is the impact the differing methods of frozen precipitation removal will have on the surrounding environment.

Presently, there exist three means for removal of frozen precipitation accumulation on paved surfaces: chemical, mechanical and thermal. All three methods presently create some significant problems for the airport operator.

Chemical means comprise any of a number of anti-icing/de-icing chemical agents, for example, glycol and urea, which may be delivered to the paved surface by a number of delivery methods. The major problem with chemical means of removal has been the environmental impact of such chemical agents. Some airports have already reported significant and ongoing problems with the runoff of chemical agents into nearby ponds or rivers. Consequently, the use of some chemical removal agents has been legally restricted or prohibited at many airports.

New, more environmentally acceptable chemicals, such as potassium acetate, have been developed as an alternative to the banned agents. Furthermore, regulations are being refined to allow for the use of containment pads and other methods for recycling or disposing of the chemical agents as another possible alternative to total prohibition.

However, the cost of such alternative methods may still prevent further widespread use of chemical agents. Thus, it is expected that the future use of many of the anti-icing/de-icing agents currently in use in the United States may be severely restricted.

Chemical agents also cause additional problems unrelated to their environmental impact. Such problems include the inability to use the runways while the chemicals are being applied and the subsequent effects of chemical residue on runway friction.

Similarly, mechanical means of frozen precipitation removal, such as plows, brooms, sweepers, sand applicators, and the like, also prevent the use of the runways during the removal process, causing a major problem for airport operators. During a heavy or lengthy storm, the delay is only exacerbated either by the need to make multiple passes to complete the removal or by a total failure to keep up with the accumulation of the frozen precipitation.

As with chemical delivery systems, the airport operator must pay to prepare and operate these mechanical means of removal. Moreover, the airport operator must pay to maintain these means, not only in times of use, but in times of non-use. In some northern regional airports, the related costs of using mechanical means of removal have become significant.

Thermal precipitation removal provides an alternative to chemical and mechanical removal, and comes in a variety of forms. Thermal energy can be applied directly to the surface by an exposed flame or an electrically-energized radiant source, or indirectly by heated pipes or electrically resistive cables, such as minerally insulated cables, buried in the upper portion of the pavement. Of these methods, the buried electrical cable method best enables heat to be applied efficiently and safely.

However, there are drawbacks to the use of buried cables. The temperature of the heated cables must be very high to obtain an adequate thermal output so as to remove all of the frozen precipitation. Additionally, the spacing between the cables must be very small, on the order of six to twelve inches, to optimize the distribution of heat transfer for a given electrical input and cable size. The spacing of the cables creates a major construction task, especially where preexisting construction would require older pavement to be destroyed prior to the laying down of the new electrical system.

An improvement in thermal removal methods came in U.S. Pat. No. 3,573,427 to Minsk. Minsk suggested that through the use of an electrically conductive asphaltic or bituminous concrete composition frozen precipitation removal could be achieved by applying a thin continuous overlay to existing pavement, thereby avoiding those major problems created by the use of cables where there is preexisting construction. Minsk further suggested that the concrete composition could be made electrically conductive by the introduction of graphite particles.

However, the compositions disclosed by Minsk lacked the stability and durability necessary for use in a wide variety of applications, including that of airport runways. Further, Minsk did not teach the use of an insulation layer of paving mixture applied over the conductive layer. Without such an insulation layer, the pavement system proposed by Minsk lacks sufficient safety for use in a wide variety of applications, especially when it is expected that humans would traverse the pavement system on a regular basis.

Therefore, it is an object of the invention to provide an electrically conductive paving mixture of increased strength and durability useful in a variety of applications, such as in airport runways and high-traffic roadways.

It is a further object of the invention to provide an electrically conductive paving mixture as part of a pavement system having reduced cost and improved safety.

SUMMARY OF THE INVENTION

According to the present invention, the foregoing and other objects of the present invention are achieved by an electrically conductive paving mixture comprising an aggregate fraction, a bituminous fraction, and a fraction of blended graphite particles. The graphite particles further comprise a naturally-occurring portion and a synthetically-produced portion.

In accordance with another aspect of the invention, an electrically conductive pavement system comprises a grid of electrically conductive cables, a layer of electrically conductive paving mixture, the paving mixture further comprising an aggregate fraction, a bituminous fraction, and a fraction of blended graphite particles, the graphite particles including a naturally-occurring portion and a synthetically-produced portion, a layer of bituminous concrete, an electrical power supply, and a control and monitoring system.

With respect to this aspect of the invention, the layer of electrically conductive paving mixture covers and surrounds the grid of electrically conductive cables. Additionally, the control and monitoring system is connected both to the grid of electrically conductive cables and the electrical power supply. In a first mode of operation, the control and monitoring system couples the power supply to the electrically conductive cables to provide the electrically conductive cables with electrical current.

DESCRIPTION OF THE PREFERRED EMBODIMENT

The preferred embodiment of the present invention is an electrically conductive paving mixture composed of a conventional bituminous concrete to which a blend of graphite particles has been added. The bituminous concrete, also known as asphaltic concrete, is composed of a mineral aggregate fraction and a bituminous fraction.

The aggregate fraction can be composed of crushed stone, crushed or uncrushed gravel, or crushed slag. The aggregate fraction may also comprise sand or inert finely divided mineral filler.

Preferably, the aggregate fraction is divided into three categories based on the size of the materials: coarse aggregate, fine aggregate and mineral filler. That portion of the aggregate fraction retained by a No. 8 sieve is coarse aggregate. The portion of the aggregate fraction passing through the No. 8 sieve, but retained by a No. 200 sieve, is fine aggregate. The portion of the aggregate fraction passing through the No. 200 sieve is mineral filler.

Depending on available sources of aggregate materials and any externally imposed specifications, such as those proposed by the Federal Aviation Agency or by state transportation authorities, which the paving surface must meet, the types of aggregate materials used and the sizes of the aggregate materials used will vary. Some properties of the paving mixture, such as strength and durability, will depend, to some extent, on the relative proportions and sizes of the aggregate materials used. The choice of a given relative combination of aggregate materials for a specific application is achieved by a selection made by those of ordinary skill in the art. The resulting aggregate fraction will constitute approximately 60 to 80 percent by weight of the electrically conductive paving mixture.

To the aggregate fraction, then, is added the blend of graphite particles. The blend is a mixture of synthetic graphite/desulfurized petroleum coke and naturally-occurring amorphous graphite. As to the thermal purification of petroleum coke into synthetic graphite/desulfurized petroleum coke, the disclosure of U.S. Pat. No. 4,288,407 to Goldberger and Markel is instructive, and is hereby incorporated by reference.

In the preferred embodiment of the invention, the relative proportion of amorphous graphite to synthetic graphite/desulfurized petroleum coke is 2:1. When added to the bituminous concrete, the blend of graphite particles will comprise 20 to 30 percent by weight of the electrically conductive paving mixture. Preferably, the blend will comprise approximately 25 percent by weight of the electrically conductive paving mixture.

Additionally, the mixture of amorphous graphite and synthetic graphite/desulfurized petroleum coke is itself preferably the combination of two different gradations of each type of graphite. A coarse and a fine gradation of amorphous graphite is combined with a coarse and a fine gradation of synthetic graphite/desulfurized petroleum coke to provide a wide spectrum of sizes of particles. In the preferred embodiment, the ratio of coarse synthetic graphite/petroleum coke (synth. coarse) to fine synthetic graphite/petroleum coke (synth. fine) to coarse amorphous graphite (amph. coarse) to fine amorphous graphite (amph. fine) is 1:3:7:3. The following table summarizes the gradations of the four different graphite used, as reflected by the percentage of particles of each of the graphites which would pass through a specific sized sieve:

| Sieve size | synth. coarse | synth. fine | amph. coarse | amph. fine |
|---|---|---|---|---|
| No. 4 | 100.0 | 100.0 | 100.0 | 100.0 |
| No. 8 | 98.9 | 100.0 | 99.1 | 100.0 |
| No. 16 | 60.0 | 100.0 | 71.9 | 100.0 |
| No. 30 | 34.5 | 100.0 | 43.2 | 99.9 |
| No. 50 | 10.7 | 99.9 | 16.3 | 99.9 |
| No. 100 | 0.3 | 48.2 | 3.6 | 29.2 |
| No. 200 | 0.1 | 19.8 | 2.2 | 7.2 |

The characteristics of the amorphous graphite and synthetic graphite/desulfurized petroleum coke complement each other in influencing the physical properties of the paving mixture when added to the bituminous concrete. For example, the synthetic graphite/desulfurized petroleum coke adds durability, resiliency, and toughness to the paving mixture. The amorphous graphite adds, for example, to the stability of the paving mixture and limits the number of voids formed within the mixture.

Additionally, the amorphous graphite and the synthetic graphite/desulfurized coke complement each other as to the electrical characteristics of the resultant paving mixture. The synthetic graphite/desulfurized petroleum coke is more conductive than the amorphous graphite. Therefore, the relative proportions of the natural to synthetic material will influence not only the physical, but also the electrical, qualities of the paving mixture.

Lastly, the bituminous fraction will be added to the combination of the aggregate fraction and the graphite blend. The bituminous fraction will constitute approximately 4 to 8 percent by weight of the electrically conductive paving mixture.

The following Examples illustrate the preparation of typical paving mixtures according to the present invention.

EXAMPLES A–D

Four electrically conductive paving mixtures were prepared. In all four mixtures, the blend of graphite particles used comprised approximately 67 percent by weight of naturally-occurring amorphous graphite and 33 percent by weight of synthetic graphite/desulfurized petroleum coke. All percentages for the blend of graphite particles are referenced to the total weight of the graphite particle blend. In all four mixtures, the aggregate fraction comprised approximately 84.6 percent by weight of coarse aggregate, 11.5 percent by weight of fine aggregate, and 3.9 percent by weight of mineral filler. All percentages for the aggregate fraction are referenced to the total weight of the aggregate fraction.

The first mixture, A, comprised an aggregate fraction of 69 percent by weight, a bituminous fraction of 5.5 percent by weight, and a graphite particle blend of 25.5 percent by weight. The second mixture, B, comprised an aggregate fraction of 68.6 percent by weight, a bituminous fraction of 6.0 percent by weight, and a graphite particle blend of 25.4 percent by weight. The third mixture, C, comprised an aggregate fraction of 68.3 percent by weight, a bituminous fraction of 6.5 percent by weight, and a graphite particle blend of 25.2 percent by weight. The fourth mixture, D, comprised an aggregate fraction of 67.9 percent by weight, a bituminous fraction of 7.0 percent by weight, and a graphite particle blend of 25.1 percent by weight. All percentages are approximate values, and are referenced with respect to the weight of the paving mixture comprising the aggregate fraction, the bituminous fraction, and the graphite particle blend.

Specimens of each of the blends were prepared according to standard ASTM procedures well known in the art. Three samples were taken from each of the specimens, and the samples were tested in accordance to methods known in the art as to five criteria: voids, voids filled, stability, flow rate, and resistivity. Average values for the mixtures are provided below:

| Mixture number | A | B | C | D |
|---|---|---|---|---|
| Voids (in percent) | 9.8 | 6.8 | 4.8 | 3.7 |
| Voids filled (in percent) | 46.5 | 61.7 | 72.2 | 79.1 |
| Stability (in lbs./inch$^2$) | 1907 | 2307 | 2487 | 2143 |
| Flow rate (in 1/100ths of an inch) | 11.7 | 12.3 | 13.0 | 14.0 |
| Resistivity (in ohm/inches) | 3.78 | 3.77 | 2.95 | 3.06 |

Application and Operation

Prior to application, the aggregate fraction, bituminous fraction, and graphite particle blend are added together and mixed at an off-site plant, and then shipped to a nearby application site. The off-site plant can be either a batch plant or a drum plant, so as to allow for continuous production. At either plant, the aggregate fraction is heated first, and then the graphite blend is combined with the heated aggregate fraction immediately before the bituminous fraction is added.

The timing of the addition of the graphite blend to the aggregate fraction is especially important. In a drum plant, where the aggregate is heated by introduction of hot air, addition of the graphite blend to the aggregate fraction too early in the process can result in much of the graphite blend being lost prematurely as a result of the hot air method used. To prevent such loss, it may be desirable to pelletize or briquette the graphite blend prior to combining it with the aggregate fraction. Similarly, in a batch plant, the handling method used to introduce the graphite to the aggregate fraction can also result in loss of a significant portion of the graphite blend. Therefore, it is important to properly handle and combine the graphite blend with the aggregate fraction and the bituminous fraction so that all the graphite enters into the mix.

Prior to the arrival of the electrically conductive paving mixture at the application site, a grid of electric lead-in conductors is placed over the surface to be paved. Preferably, the grid comprises a series of copper cables, each cable being laid parallel to the other cables.

The copper cables are preferably spaced so that there is a voltage drop of approximately 7 volts per foot in the finished pavement. Consequently, for a 120 volt system, the cables should be spaced approximately 16 to 17 feet apart.

Similarly, the size of the copper cables is preferably selected so that the diameter of the cable is half the thickness of the conductive layer, and the number of copper cables is selected so that preferably the current density in the copper cable is less than 1200 amps per square inch, the current density at the surface of the cable is less than 0.25 amps per square inch, and the current density in the conductive layer is less than 0.30 amps per square inch. By thus limiting the current density, the possibility of localized heating is minimized.

Preferably, the copper cables are of rope-lay construction. By using cables of rope-lay construction, the stresses in the conductive layer caused by the expansion and contraction of the cables during the periods of heating and cooling will be minimized. In turn, this reduction of stresses will limit the development of cracks in the conductive layer. The construction of the cables also increases the durability of the conductive layer by making the cables more flexible for responding to movement of the underlying surface or for responding to movement of the conductive layer itself.

In the preferred embodiment, each copper cable includes 61 concentric stranded members. Each member is itself is preferably comprised of seven small-diameter twined copper wires. Most preferably, such cables are 500 MCM cables, with an outside diameter of approximately 0.92 inches and comprised of 427 wires, each wire being approximately 0.034 inches in diameter.

Preferably, a pavement system is constructed having two layers of paving mixture laid over the grid of electric lead-in conductors, a lower layer, or electrically conductive layer, of electrically conductive paving mixture and an upper layer, or insulation layer, of bituminous concrete. The electrically conductive layer is laid first. Preferably, the electrically conductive layer has a depth of 1.5 to 2 inches, varying in relationship to the size of the aggregate materials used in the electrically conductive paving mixture.

In some installations, it may be desirable to lay a waterproof membrane or fabric layer over the conductive layer prior to covering the conductive layer with the insulation layer. The fabric layer, preferably comprised of a non-woven fabric commonly used in roadway construction, would provide additional insulative protection, increased durability, and improved resistance to water seepage and resultant cracking in the conductive layer.

The insulation layer is then applied over either the conductive layer or the combination of the conductive layer and the fabric layer. The insulation layer of bituminous concrete is extended approximately an additional twelve inches around the perimeter of the electrically conductive layer. The insulation layer is laid to cover the conductive layer with at least 1.5 inches in depth of bituminous concrete, and further providing at least 3 to 3.5 inches in depth of bituminous concrete in the extended portion around the perimeter of the electrically conductive layer.

The insulation layer is useful in at least two ways. Primarily, the insulation layer limits the effects of the electrical current running through the electrically conductive layer on objects or personnel that would normally travel across the surface to which the paving mixture is to be applied. Second, the insulation layer serves to limit the exposure of the electrically conductive layer to the effects of the environment, such as weather and traffic, for example.

After the insulation layer of the pavement system has been laid, sensors are fitted into the surface of the insulation layer of the pavement system which is exposed to the environment. These sensors are coupled to an electrical control and monitoring system, and provide the control and monitoring system with readings of temperature and moisture at the exposed surface of the insulation layer of the pavement system.

Both the sensors and the control and monitoring system used are commonly known to those skilled in the art and are oftentimes already available where there is pre-existing airport construction. Where the airport already has a pre-existing monitoring system installed capable of receiving inputs from remotely placed sensors, it is possible for one of ordinary skill in the art to modify the monitoring system to respond to a remote activation signal and, in response to the remote activation signal, to provide an output which can be used to control the supply of current to the electrical cables from an externally-mounted electrical power supply.

In operation, the pavement system can preferably be remotely activated to prevent the accumulation of frozen precipitation on the surface of the pavement system before the frozen precipitation begins to develop. Once the pavement system has been activated, the control and monitoring system will supply a current to the electrically conductive cables, preferably from an externally-mounted electrical power supply. The current supplied to the cables will in turn pass through the electrically conductive paving mixture, thereby generating heat.

The control and monitoring system adjusts the current to maintain a constant temperature level just above freezing on the surface of the pavement system until the sensors indicate that the surface is dry. Once the surface is dry, the control and monitoring system will automatically turn off the current being supplied to the pavement system.

Through the use of such a system, the airlines will see increased savings as a result of reduced delays and cancellations caused by adverse weather conditions. Passengers will also experience less inconvenience in travel.

While the initial capital expenditure of such a pavement system may be sizeable, the cost of installing the thermal removal system described herein will come at an overall reduced price with respect to other removal systems. That is, the cost of installing such a system should more than be offset by savings, both direct and incidental, realized by the elimination of chemical or physical frozen precipitation removal systems.

While this invention has been described with reference to an illustrative embodiment, it will be understood that this description is not intended to be construed in a limiting sense. Various modifications of the illustrative embodiments, as well as those other embodiments, will become apparent to those skilled in the art upon reference to this description. The invention is intended to be sent forth in the following claims.

We claim:

1. An electrically conductive paving mixture comprising:

an aggregate fraction;

a bituminous fraction; and a fraction of blended graphite particles, the graphite particles further comprising a naturally-occurring portion and a synthetically-produced portion.

2. An electrically conductive paving mixture comprising:

an aggregate fraction;

a bituminous fraction; and a fraction of blended graphite particles, the graphite particles further comprising a naturally-occurring portion and a synthetically-produced portion in a ratio of 2:1.

3. The electrically conductive paving mixture according to claim 2, wherein the aggregate fraction comprises 60 to 80 percent by weight of the paving mixture, the bituminous fraction comprises 4 to 8 percent by weight of the paving mixture, and the graphite particles comprise 20 to 30 percent by weight of the paving mixture.

4. The electrically conductive paving mixture according to claim 3, wherein the graphite particles comprise 25 percent by weight of the paving mixture.

5. The electrically conductive paving mixture according to claim 2, wherein the graphite particles comprise a coarse synthetically-produced portion, a fine synthetically-produced portion, a coarse naturally-occurring portion and a fine naturally-occurring portion in a ratio of 1:3:7:3.

6. An electrically conductive pavement system comprising:

a grid of electrically conductive cables;

a layer of electrically conductive paving mixture covering and surrounding the grid, the paving mixture further comprising an aggregate fraction, a bituminous fraction, and a fraction of blended graphite particles, the graphite particles having a naturally-occurring portion and a synthetically-produced portion;

a layer of bituminous concrete laid over the layer of electrically conductive paving mixture;

an electrical power supply; and a control and monitoring system, connected to the grid of electrically conductive cables and the electrical power supply, wherein a first mode of operation the control and monitoring system couples the power supply to the electrically conductive cables to provide the electrically conductive cables with electrical current.

7. The electrically conductive pavement system according to claim 6, wherein the ratio of the naturally-occurring portion of the graphite particles to the synthetically-produced portion of the graphite particles is 2:1.

8. The electrically conductive pavement system according to claim 7, wherein the aggregate fraction comprises 60 to 80 percent by weight of the paving mixture, the bituminous fraction comprises 4 to 8 percent by weight of the paving mixture, and the graphite particles comprise 20 to 30 percent by weight of the paving mixture.

9. The electrically conductive pavement system according to claim 8, wherein the graphite particles comprise 25 percent by weight of the paving mixture.

10. The electrically conductive pavement system according to claim 7, wherein the graphite particles comprise a coarse synthetically-produced portion, a fine synthetically-produced portion, a coarse naturally-occurring portion and a fine naturally-occurring portion in a ratio of 1:3:7:3.

11. The electrically conductive pavement system according to claim 6, further comprising a fabric layer, placed between the layer of electrically conductive paving mixture and the layer of bituminous concrete.

12. The electrically conductive pavement system according to claim 6, further comprising sensors embedded in the layer of bituminous concrete, responsive to changes in moisture and temperature, and coupled to the control and monitoring system.

13. The electrically conductive pavement system according to claim 12, wherein the first mode of operation ends when the sensors detect a first moisture state.

* * * * *